US006059332A

United States Patent [19]

Beascoechea Inchaurraga

[11] Patent Number: 6,059,332

[45] Date of Patent: May 9, 2000

[54] COLLECTOR FOR EXCRETA FROM DOMESTIC ANIMALS

[76] Inventor: Raimundo Beascoechea Inchaurraga, Asival, s/n, Poligono Ind. Ca'n Valero, 07011 Palma de Mallorca, Spain

[21] Appl. No.: 09/234,579

[22] Filed: Jan. 21, 1999

[30] Foreign Application Priority Data

Jan. 21, 1998 [ES] Spain ..... 9800107

[51] Int. Cl.[7] ..... A01K 29/00; E01H 1/12

[52] U.S. Cl. ..... 294/1.3

[58] Field of Search ..... 294/1.3–1.5, 25, 294/55, 99.2; 15/257.1, 257.6, 257.7, 104.8

[56] References Cited

U.S. PATENT DOCUMENTS

| | | | |
|---|---|---|---|
| 3,560,039 | 2/1971 | Gruber | 294/1.3 |
| 5,385,376 | 1/1995 | Malaspina et al. | 294/1.3 |
| 5,476,296 | 12/1995 | Gross | 294/1.3 |
| 5,503,442 | 4/1996 | Lee | 294/1.4 |
| 5,669,645 | 9/1997 | Chuang | 294/1.3 |

FOREIGN PATENT DOCUMENTS

| | | | |
|---|---|---|---|
| 651-873 | 10/1985 | Switzerland | 294/1.3 |
| 2032831 | 5/1980 | United Kingdom | 294/1.3 |
| 2034234 | 6/1980 | United Kingdom | 294/1.3 |
| 83/03436 | 10/1983 | WIPO | 294/1.3 |

*Primary Examiner*—Dean J. Kramer
*Attorney, Agent, or Firm*—Ostrolenk, Faber, Gerb & Soffen, LLP

[57] ABSTRACT

A collector for excreta from domestic animals such as dogs, is formed by two rectangular frames, equal and facing each other, and joined by a rear concave-convex wall that forms an articulation for the collector in the form of pincers. The wall has a central opening that makes the articulation flexible. On the convex face of the wall are two ribs laterally aligned that aid in holding a transversal cylindrical tube closed at one end. The tube contains a continuous roll of bags, closed by a cap at one end. The tube further has an opening at another end in the axial direction. A central tab or jutting part, through which opening the free end of the bag passes, attaches to the central hole in a perforated transversal line which divides two consecutive bags, thereby making removal easier. The plastic bag is fitted so that it covers the collector pincers. The bottom of the bag is disposed inside the pincers next to the cylindrical tube.

9 Claims, 2 Drawing Sheets

COLLECTOR FOR EXCRETA FROM DOMESTIC ANIMALS

The object of the present invention is a collector for excreta from domestic animals, such as dogs.

The problems caused by the excreta of domestic animals, particularly dogs, when they defecate in the streets and parks of urban areas, are well known.

The owners are willing to solve these problems but cannot find easy means of doing so.

In general, attempts have been made to design particularly complex and large devices that, aside from being impractical, are inconvenient to carry.

On the other hand, attempts have been made to solve the problem by the municipal authorities setting aside appropriate zones where dogs may defecate, but this does not solve the problem either.

Excreta stain the zones of normal transit, giving the area a bad image, and at the same time, for example, damage the grass in the parks.

In order to solve these problems, the collector of the invention has been designed so that the dog owner can use it easily, quickly, cleanly and safely.

Furthermore, the collector has a closed seating for the plastic bags used to collect the excreta.

SUMMARY OF THE INVENTION

According to the invention, the collector is moulded in plastic and has the shape and operation of pincers.

Therefore the collector has two equal, facing parts with a rectangular frame shape, each of which has an outward curvature.

These frames are joined at one end of the pincers by a concave-convex surface with a central zone with an oval indentation.

This concave-convex surface has on its convex face two laterally aligned raised portions which are in turn attached to a cylindrical tube placed transversally and in parallel to the said surface.

This tube is closed at one end and has inside a continuous roll of plastic bags and said tube can easily be closed by a removable cap.

The continuous roll of bags has a transversally perforated line that ends each bag and in the centre of the perforated line is a cut.

The user places the free end of the roll through a slit in the cylindrical tube in the starting position. A tab juts out from the slit and is placed in the cut or slit of the previously mentioned continuous roll so that with a slight pressure, this coupling aids in disconnecting the bag. The bag is placed appropriately between the two frames of the pincers, covering them and leaving the bottom of the bag between the frames and next to the cylindrical tube. In this way, when the pincers are opened the animal excreta are collected inside the bag and once the bag is removed from the pincers it can be placed in the nearest waste bin.

BRIEF DESCRIPTION OF THE DRAWINGS

In order to more easily understand not only the formation but also the use of the collector of the invention, reference is made below to a practical example, the execution of which is merely enunciative and in no case limits the same, all as shown in the attached drawings, where.

DETAILED DESCRIPTION OF THE PREFERRED EMBODIMENT

Figure 1:
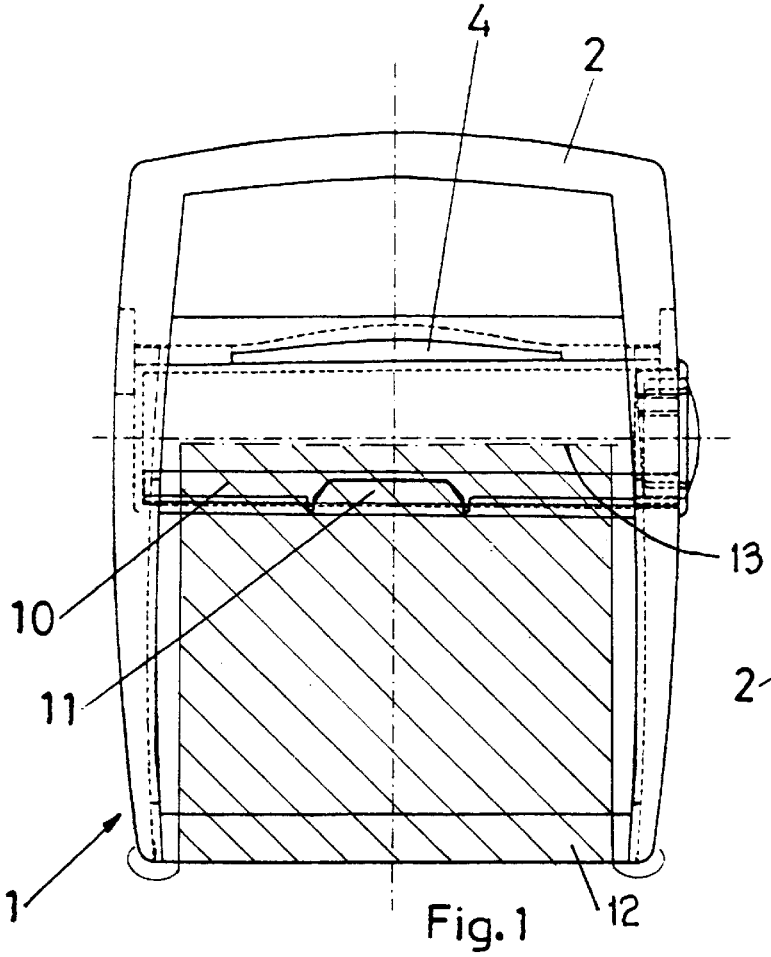
FIG. 1 shows a front view of the collector of the invention.
Figure 2:
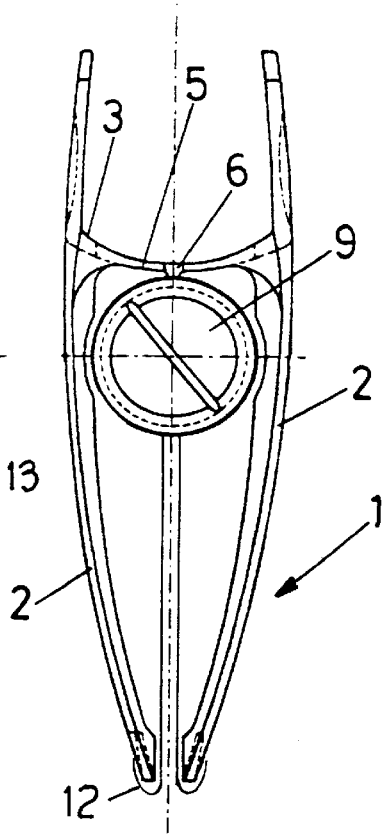
FIG. 2 shows a side view of FIG. 1.
Figure 3:
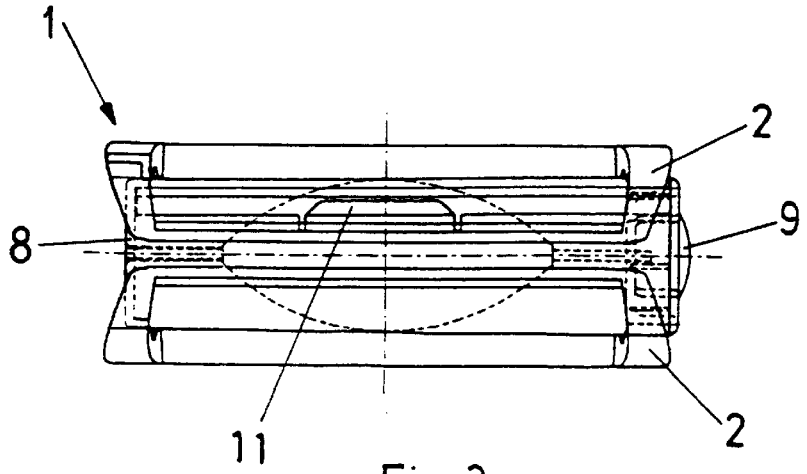
FIG. 3 shows a bottom view of FIG. 1.
Figure 4:
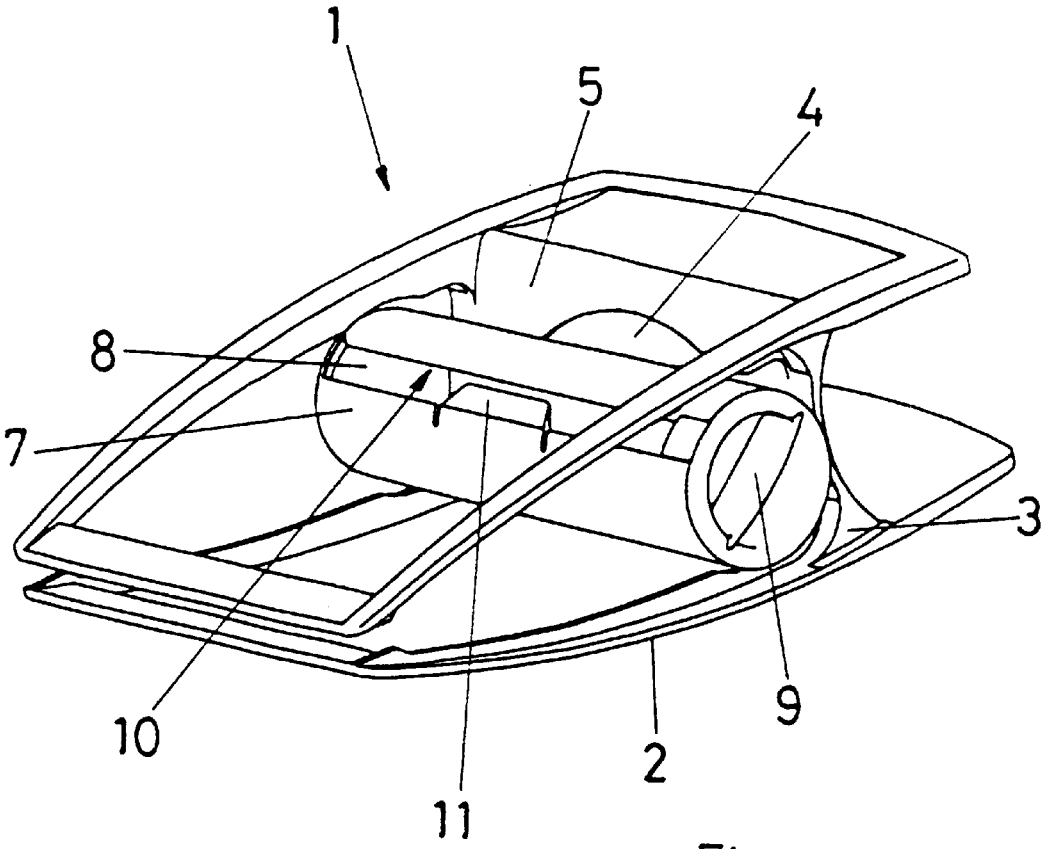
FIG. 4 shows a view in perspective of the collector.
Figure 5:
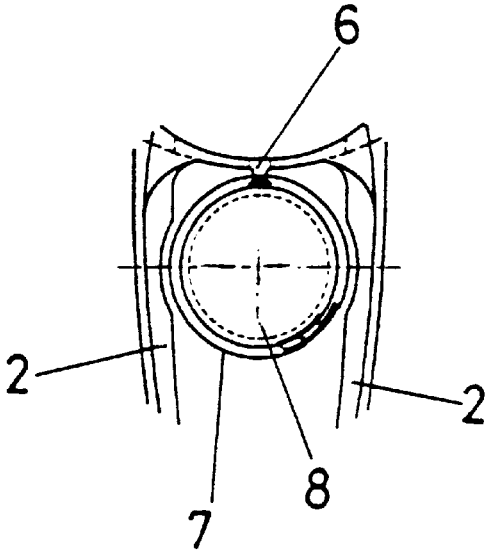
FIG. 5 shows a detailed view of the articulation with the cylindrical tube., The collector 1 is preferably made of plastic.

The collector 1 has the form of pincers and is made up of two similar rectangular frames 2 facing each other and arching outwards, joined by a rear concave-convex wall 3 placed in a transversal direction, and having a central opening 4 noticeably ovaloid which gives the said wall 3 the characteristics of a very flexible articulation.

The convex face 5 of the wall 3 has some lateral ribs 6 against the opening 4 and aligned by them a cylindrical tube 7 is positioned and fixed parallel to the curvature of the said wall 3.

This tube 7 is closed at one end 8 and open, although closed by a cap 9, at the other end.

The tube 7 has an opening 10 along its axis on which is centred a tab 11 with a trapezoid shape.

A continuous roll of bags, not shown, is placed inside the tube, and these bags have a transversal perforated line 13 and a central cut into which the tab 11 is placed, so that it is easy to remove a bag 12 out of the pincers.

When in use, the front part of the collector forms the closure of the pincers which are lined by the bag in order to be able to collect the dog excreta when the pincers are opened and the bag perfectly positioned. In this way, the opening angle of the pincers is variable but sufficient to carry out the operation of collecting the excreta correctly and easily.

What is claimed is:

1. A collector for excreta comprising:

two frames facing each other and joined by a rear wall, said frames and wall forming an articulation for said collector in the form of pincers;

a container disposed on an inside of said wall, said container having a continuous roll of bags;

said container having an opening with a tab extending therein, said opening being effective to allow said bag to pass therethrough, said tab attaching to a perforated transversal line dividing consecutive bags, making removal of one of said bags easier, said bag being fitted so that it covers said pincers and a bottom of said bag being disposed next to said container.

2. The collector as claimed in claim 1 wherein said wall has a central opening thereby making said articulation more flexible.

3. The collector as claimed in claim 1 wherein said wall has laterally aligned ribs that aid in holding said container within said collector.

4. The collector as claimed in claim 1 wherein said container is a cylindrical tube.

5. A collector for excreta, said collector comprising:

a first and second frame coupled to pivot together and apart; and a container disposed between said frames, said container having a continuous roll of bags disposed within the container with neighboring bags separated by a perforation, said container having an opening which allows each said bag to pass therethrough so that a portion of said bag covers said first and second frame;

said container further including a tab placed to be between adjacent bags moving out of said container for facilitating disengagement of adjacent bags at the perforations.

6. The collector as claimed in claim 5, wherein said first and second frame are connected by a wall and the coupling together of the frames comprises a central opening in said wall, thereby making an articulation between said first and second frames flexible.

7. The collector as claimed in claim 5, wherein said frames are connected by a wall at which said frames are pivotally coupled; and said wall has laterally aligned ribs that aid in holding said container.

8. The collector as claimed in claim 5, wherein said container is a cylindrical tube.

9. The collector as claimed in claim 5, wherein an operated bag has said portion covering said frames and a bottom of said operated bag is disposed near said container.

* * * * *